United States Patent [19]

Montorfano et al.

[11] Patent Number: 4,479,373

[45] Date of Patent: Oct. 30, 1984

[54] TUBE BENDING ASSEMBLY, PARTICULARLY FOR THIN WALL AND SMALL AND MEDIUM DIAMETER METAL TUBES

[75] Inventors: Renzo Montorfano, Cantù ; Virginio Montorfano, Capiago, both of Italy

[73] Assignee: Officina Meccanica Montorfano S.n.c. di Montorfano Virginio e Renzo, Cantù , Italy

[21] Appl. No.: 393,627

[22] Filed: Jun. 29, 1982

[30] Foreign Application Priority Data

Jul. 10, 1981 [IT] Italy ..... 22872 A/81

[51] Int. Cl.[3] ..... B21D 7/04

[52] U.S. Cl. ..... 72/158; 72/159

[58] Field of Search ..... 72/149, 154, 155, 156, 72/216, 217, 306, 319, 321, 158

[56] References Cited

U.S. PATENT DOCUMENTS

| | | | |
|---|---|---|---|
| 3,147,792 | 9/1964 | Hautau | 72/157 |
| 3,155,139 | 11/1964 | Hautau | 72/150 |
| 3,299,681 | 1/1967 | Hautau | 72/7 |

FOREIGN PATENT DOCUMENTS

| | | | |
|---|---|---|---|
| 2101162 | 7/1972 | Fed. Rep. of Germany | 72/157 |
| 2910174 | 9/1980 | Fed. Rep. of Germany | 72/157 |
| 927262 | 5/1963 | United Kingdom | 72/306 |
| 1435033 | 5/1967 | United Kingdom | 72/306 |

*Primary Examiner*—E. Michael Combs
*Assistant Examiner*—Charles Rosenberg
*Attorney, Agent, or Firm*—Young & Thompson

[57] ABSTRACT

The bending assembly for one or more tubes at a time comprises a matrix or die with substantially smooth cylindrical skirt and a sliding block provided with a groove for receiving the tubes to be bent and angularly rotatable relative to the matrix or die. The matrix or die and sliding block, along with a bearing shoulder for the tube to be bent, are retractable in a direction at right angles to the bending plane. In addition to the bending assembly, the apparatus comprises clamping devices and also structure for automatic centering of the tube and taking up of the tolerance on the legs or between different bendings. These last mentioned devices are arranged in line in a same structure, the bending and clamping devices being mounted on slides.

15 Claims, 32 Drawing Figures

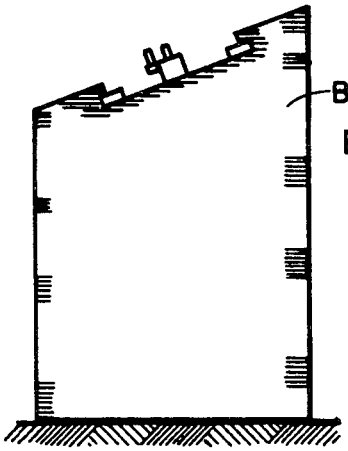
Fig. 5
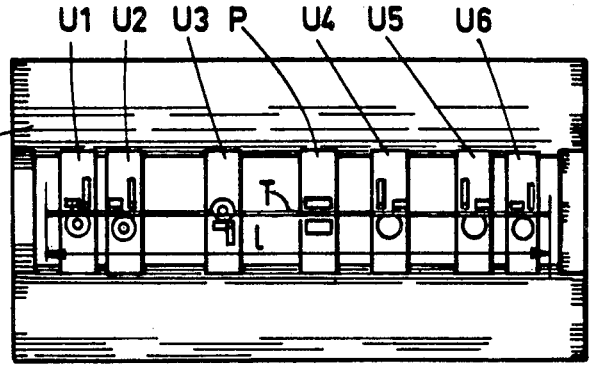
Fig. 6
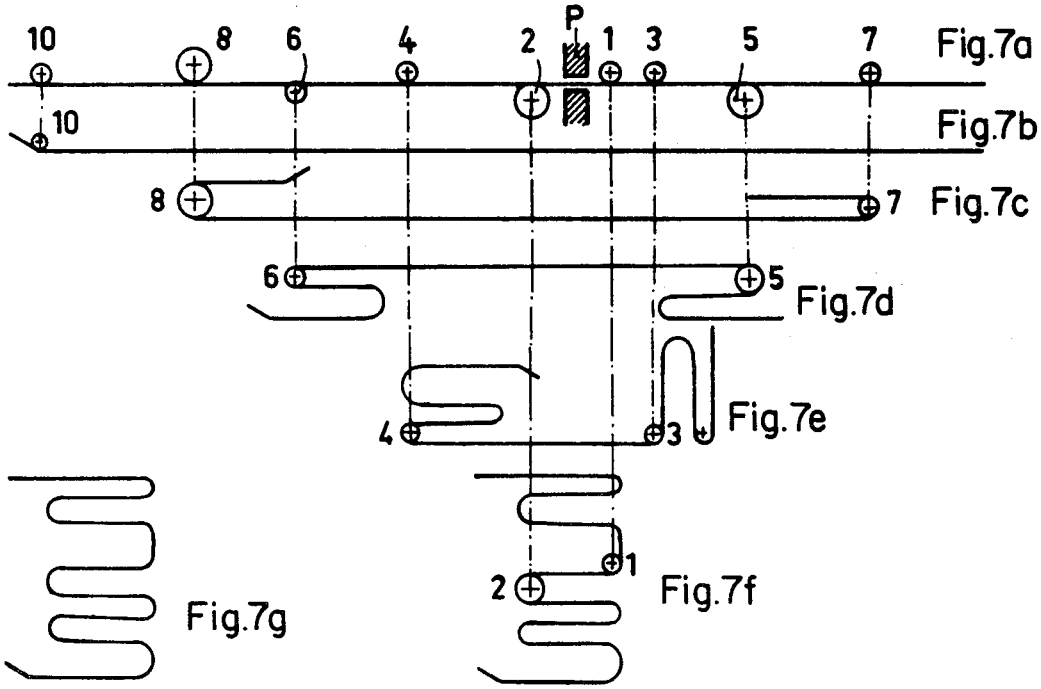

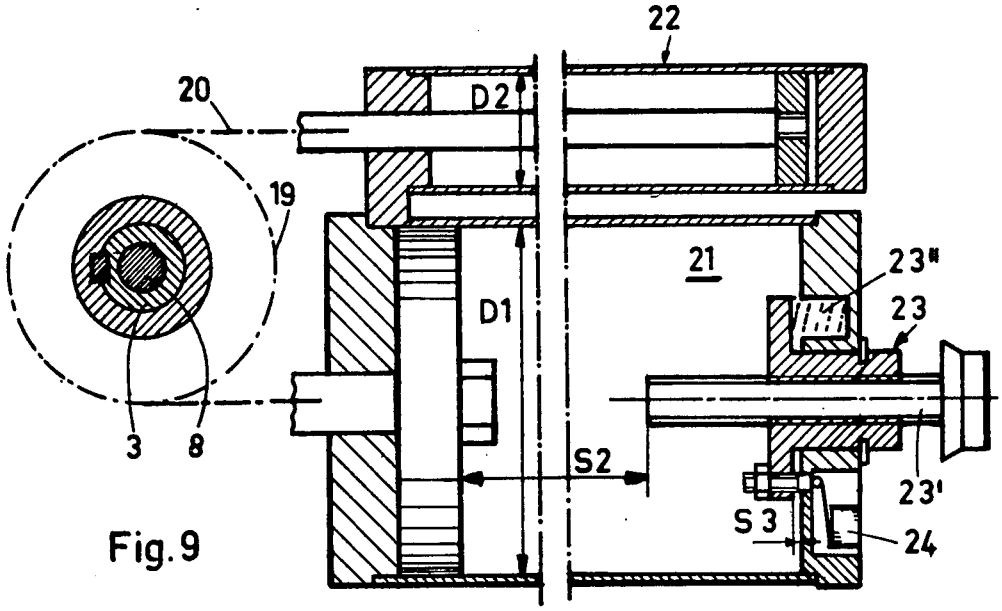
Fig. 9
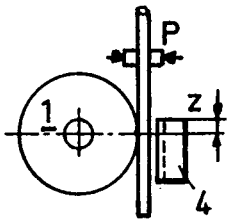
Fig.8a
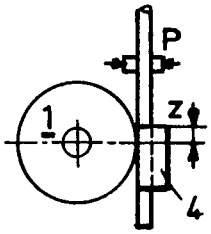
Fig.8b
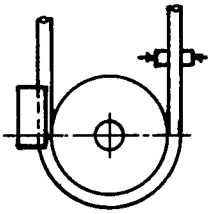
Fig.8c
Fig.8f
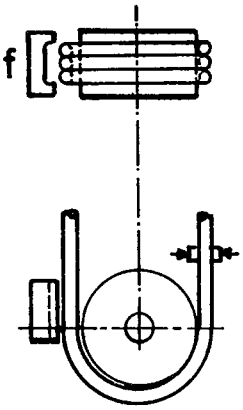
Fig.8d
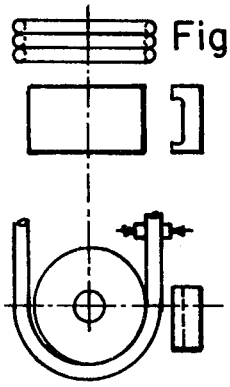
Fig.8g
Fig.8e
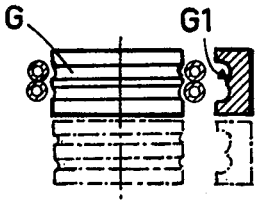
Fig. 10 x2

P5
P7
P10
P11
P14
P16
P15
P4
P1
DB
P2
P3
P6
40
41
42
43
83
68
67
65
71
01
02
62
70
68'
71'
S1'
S2'
S3'
T
x
x1
x2
l1
B

TUBE BENDING ASSEMBLY, PARTICULARLY FOR THIN WALL AND SMALL AND MEDIUM DIAMETER METAL TUBES

This invention relates to a bending assembly for tubes and wires, particularly metal tubes having small and medium diameter and thin wall.

The invention further contemplates a process for the operation of said assembly.

It is well known that a bending operation, particularly for tubes having small diameter and thin wall, meets with considerable technical difficulties in that the tube section does not maintain a circular configuration upon bending, but is liable to flattening depending inter alia on the bending radius and size of the tube.

In order to control permanent set or deformation, several expedients are pratically resorted to, but which are difficult and costly such as, for example, the introduction of a flexible core or spindle into the tube to be bent.

For mass production, in a known type of machine the tube to be bent is threaded on a core in order to avoid any ovalization of the tube as the latter is being bent. Then, the forward end of the tube first inserted in the machine is gripped by a jaw, the rotation of the latter about the matrix or die axis causing the tube to coil on said matrix or die, while a slide accompanies the linear motion of the tube to avoid the deflection thereof.

The hitherto known tube bending machines commonly have the disadvantageous characteristic that the tube section or length, on which the bendings are provided, is introduced from one end of the machine and then forwardly moved along the machine as the bendings are made in succession one after the other. Therefore, in these machines bendings are individually made and beginning from one end, that is from the tube end first introduced in said machine.

Thus, prior art machines allow carrying out only one bending at a time and for each subsequent bending require a particular handling of the tube.

It is the object of the present invention to obviate the above mentioned disadvantages. It is also the object of the invention to provide a bending assembly or unit enabling to bend one or simultaneously a plurality of tubes, also ensuring that the same will maintain a circular section even after bending, or anyhow such that the flattening thereof is kept within maximum established deformation limits.

According to the present invention, the bending assembly or unit is characterized by comprising a matrix or die with substantially smooth cylindrical skirt; a sliding block provided with an elongated rectilinear groove which, relative to a location tangent to the tubes with the die, is extended in the opposite direction to the direction of rotation of the sliding block as the tube is bent; prior to bending, said sliding block groove and a bearing plane for the tube being arranged parallel to the longitudinal axis of the tube to be bent; said matrix or die and sliding block and shoulder being also preferably retractable in perpendicular direction and relative to the bending plane and upon bending.

The process for the operation of said assembly or unit comprises the succession of the following steps:

introducing the required number of tubes between the respective matrices or dies and sliding blocks thereof;

clamping these tubes by means of a central clamping device;

moving the sliding block toward the die;

angular rotation of the sliding block about the die axis;

separation of the sliding block from the die; and return of the sliding block to its starting position and simultaneous retraction of the die and sliding block to allow the successive bending operations.

The invention also relates to means for carrying out the process, comprising a die with substantially smooth cylindrical surface or having thereon formed one or more grooves of a depth at least nearly equal to the elastic deformation of the portion of bent tube; a sliding block with an elongated rectilinear groove which relative to a location tangent with the die is extended in the opposite direction to the direction of rotation of the sliding block as the tube is bent.

For better explanation, the accompanying drawings show a preferred non-restrictive embodiment of the invention.

In the accompanying drawings:

FIG. 5 is a side view of a structure with mounting plane for a plurality of inclined bending assemblies or units;

FIG. 6 is a view at right angles to the inclined plane shown in FIG. 5, said plane having six bending assemblies and a clamping device mounted thereon;

FIG. 7 is a view schematically showing the bending sequence for one or more superimposed tubes from detail (a) to detail (g);

Figure 24:
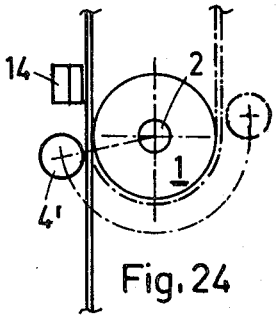
Figure 12:
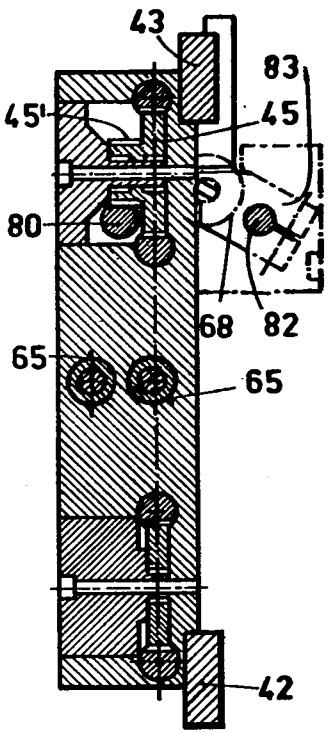
Figure 11:
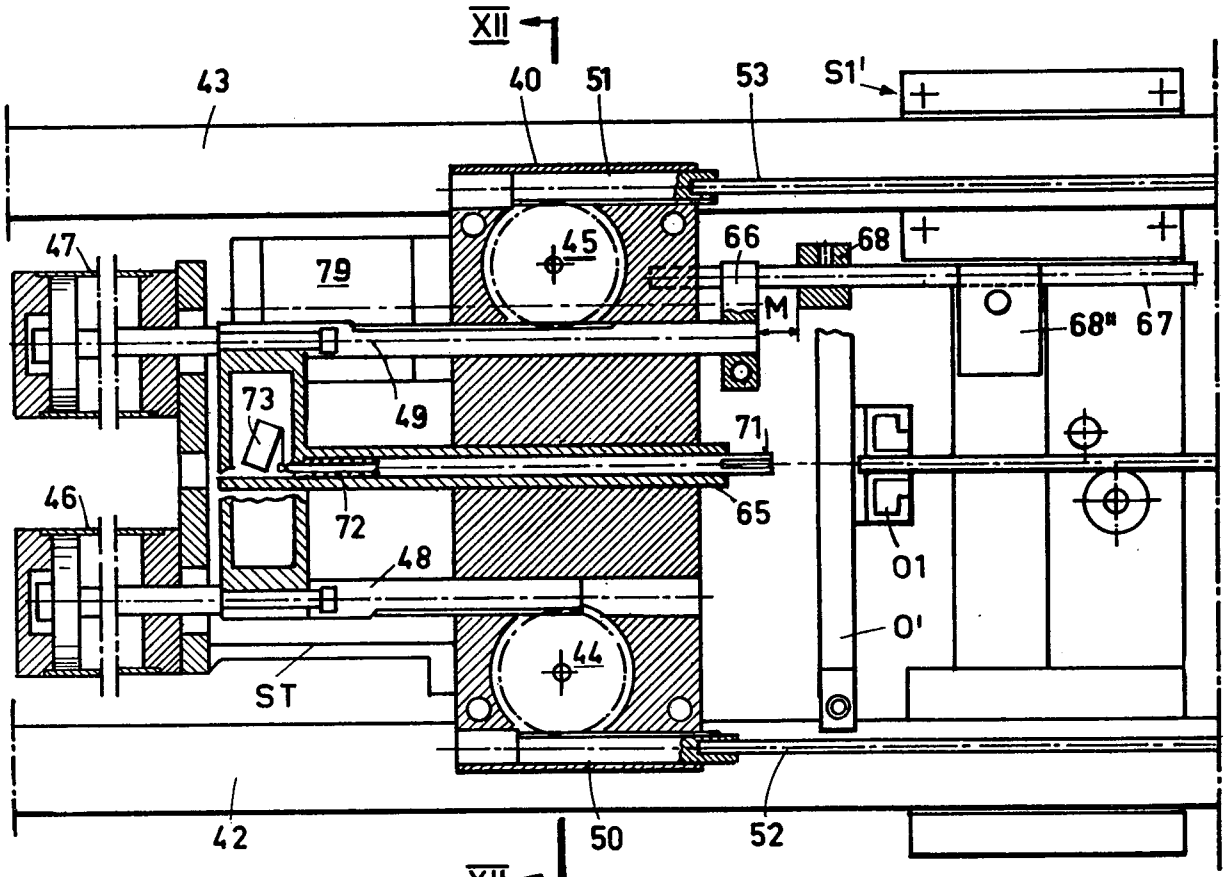
Figure 13:
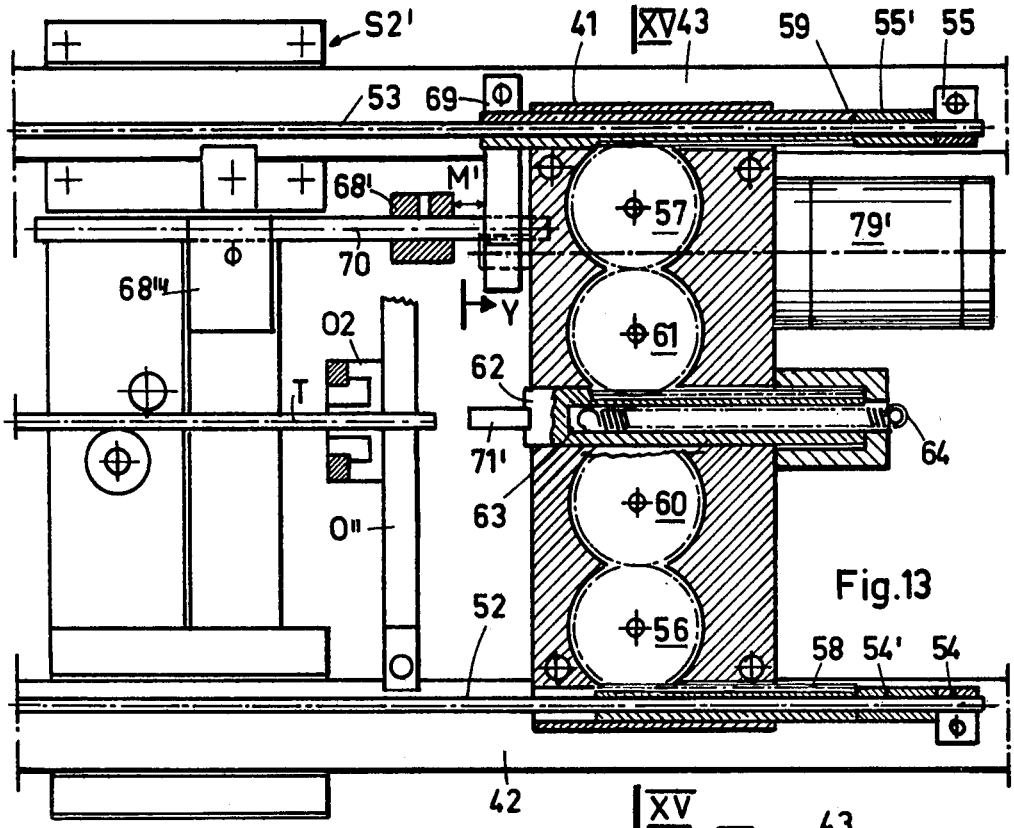
Figure 23:
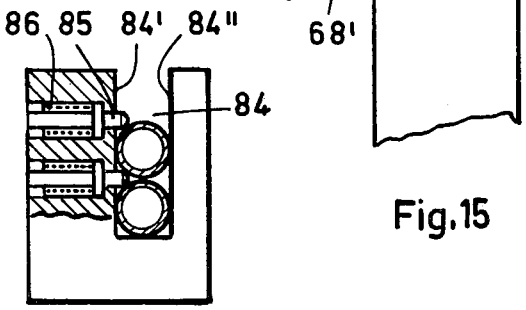
Figure 15:
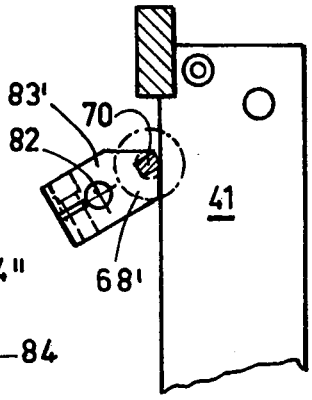
Figure 14:
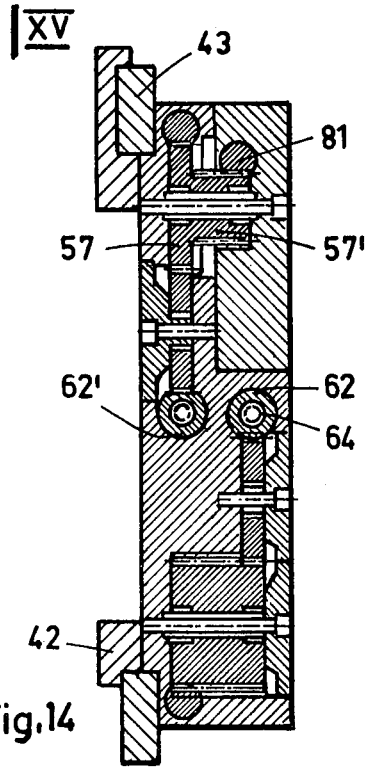
Figure 17:
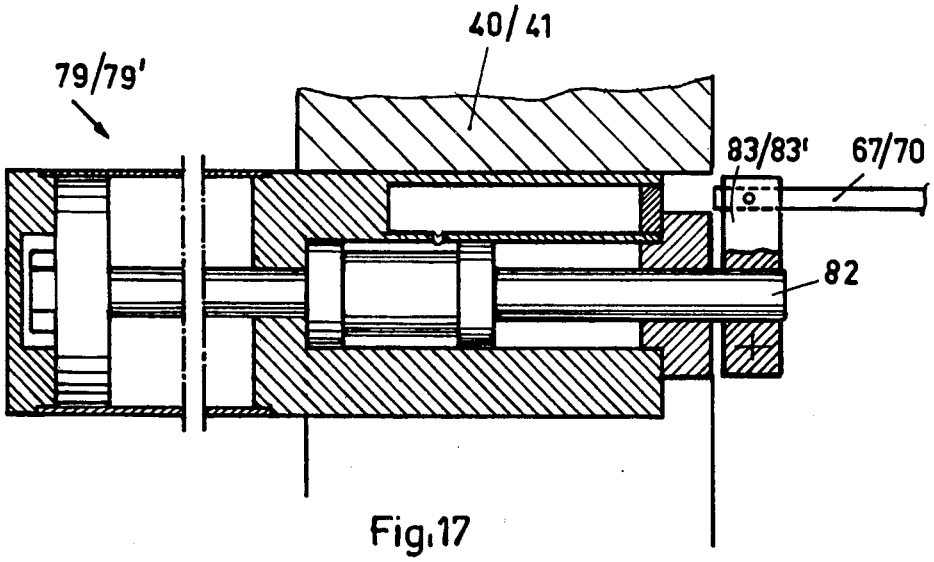
Figure 16:
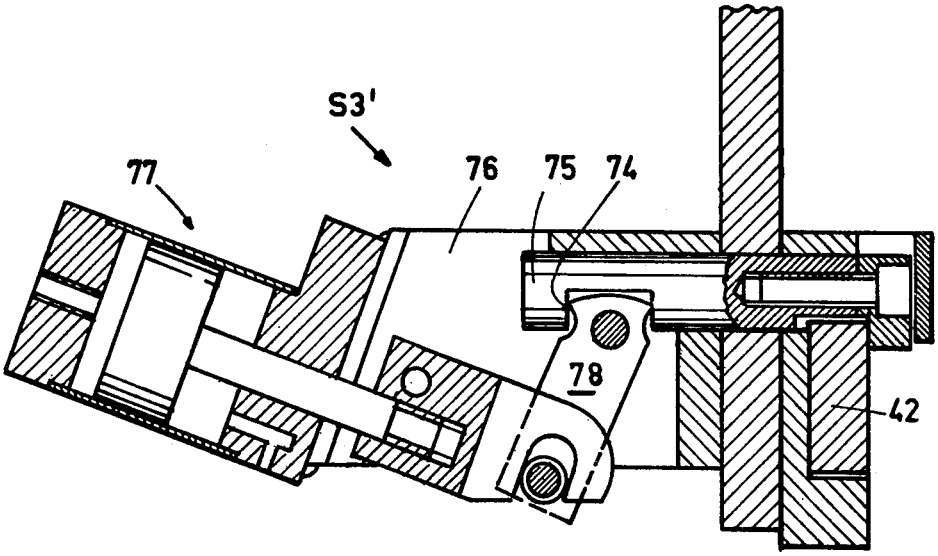
Figures 18A, 18B, 19, 20, 21, 22:
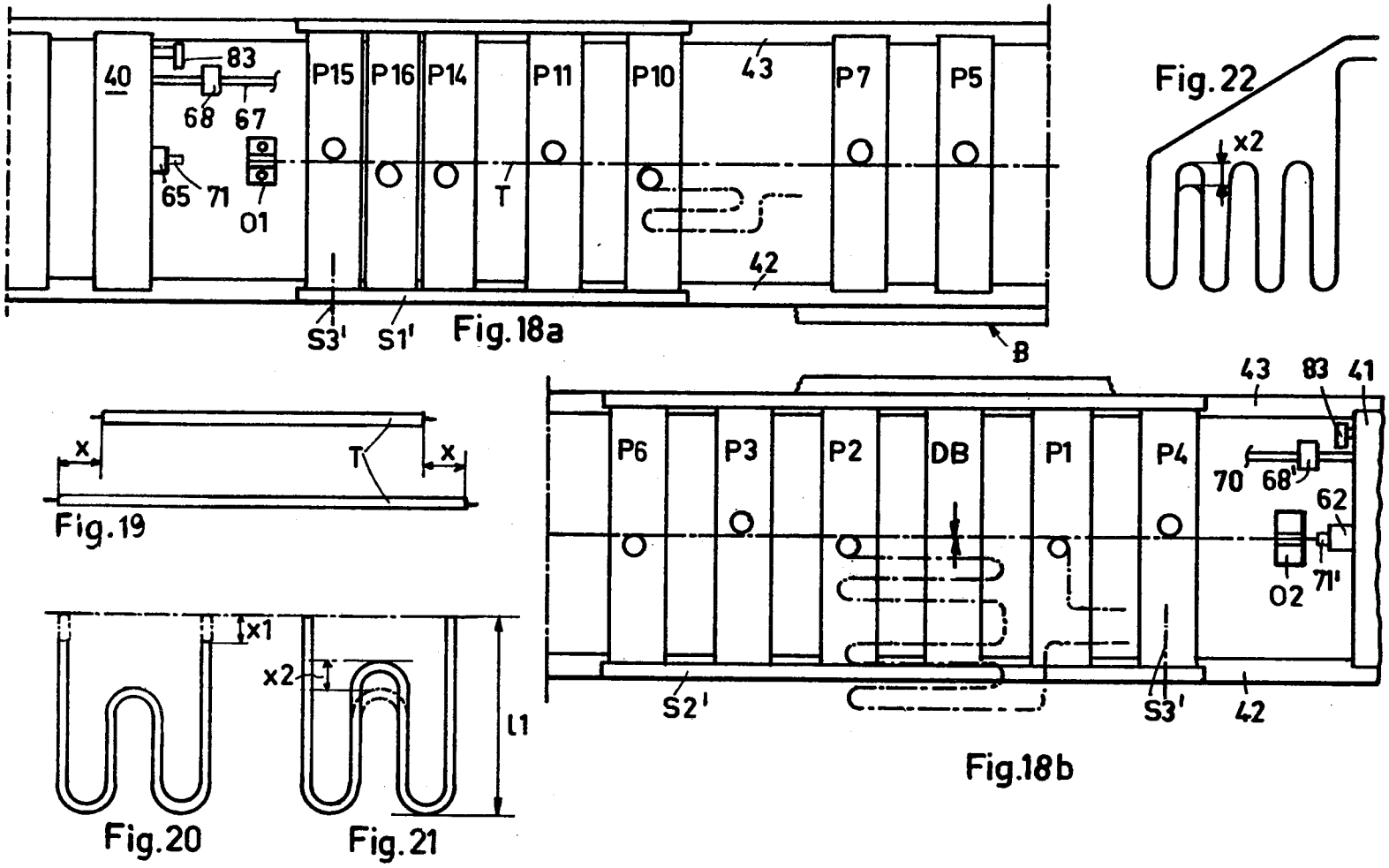

FIGS. 8*a*–8*f* are views schematically showing the insertion operations for tube clamping and bending;

FIG. 9 shows in a partly cut away view the piston-cylinder assemblies and means for reciprocation of the folder sliding block;

FIG. 10 is a view schematically showing the retraction position taken by a grooved die and sliding block thereof;

FIG. 11 is a partly front, and partly cut away view showing the arrangement of head 40 and slidable slide with bending assembly;

FIG. 12 is a vertical sectional view taken along line XII—XII of FIG. 11;

FIG. 13 is a view substantially showing the parts of FIG. 11 arranged at the right side of an apparatus;

FIG. 14 is a vertical sectional view taken along line XV—XV of FIG. 13;

FIG. 15 is a fragmentary view of a head in the direction of arrow Y in FIG. 13;

FIG. 16 is a longitudinal vertical sectional view showing the clamping assembly for the slidable slide;

FIG. 17 is a longitudinal sectional view of a hydropneumatic cylinder for the return of a slidable slide;

FIG. 18*a–b* schematically shows the arrangement of centering elements and bending assemblies;

FIG. 19 is a view showing two tubes as positioned upon centering operation;

FIG. 20 is a view showing a curved tube with constant centers of bending, in which the tolerance previously existing on the tube is transferred to the tube ends;

FIG. 21 is a view showing how the tolerance between the bendings is taken up to provide the same outer sizes for the tube;

FIG. 22 is a view schematically showing a curved tube with indication of possible take up of the tolerance between one bending to provide the same outer sizes;

FIG. 23 is a cross-sectional view of a tube positioner or support with the tube being centered or respectively bent; and FIG. 24 is a schematic top plan view showing a bending assembly in which the bending displacement is carried out by a roller.

Figure 2:
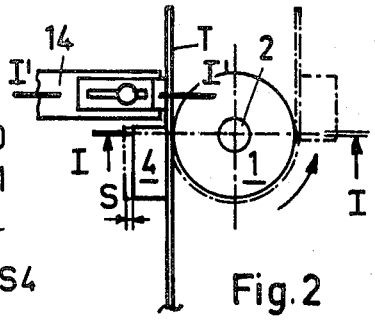
FIG. 2 is a schematic top plan view of a bending assembly or unit, showing the die, folder sliding block and tube bearing shoulder.
Figure 4:
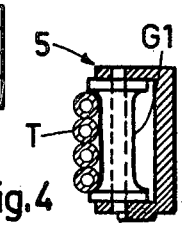
FIG. 4 is a cross-sectional view taken along line IV—IV of FIG. 3.
Figure 3:
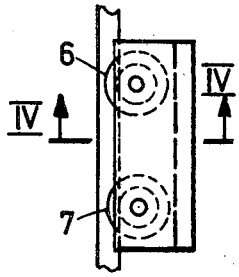
FIG. 3 is a top view showing a modified folder sliding block provided with shaped rollers.

According to the present invention, a bending assembly (FIG. 1) comprises a die 1 freely rotable on a pin 2, which die is coaxial with a member 3 passing through the entire assembly or unit. Still referring to FIG. 1, a sliding block 4 is provided for receiving four tubes T and capable of travelling through a stroke S to move away from and respectively toward the die for insertion of tubes and pressing the same against said die. Advantageously, the sliding block 5 (FIGS. 3 and 4) can be provided with two or even a plurality of rollers 6 and 7, so shaped as to contain the tubes being bent closely adjacent to one another. In this case, one of said rollers will be on the axis I—I (FIG. 2) to support the wires during bending and prevent the ovalization thereof.

Figure 1:
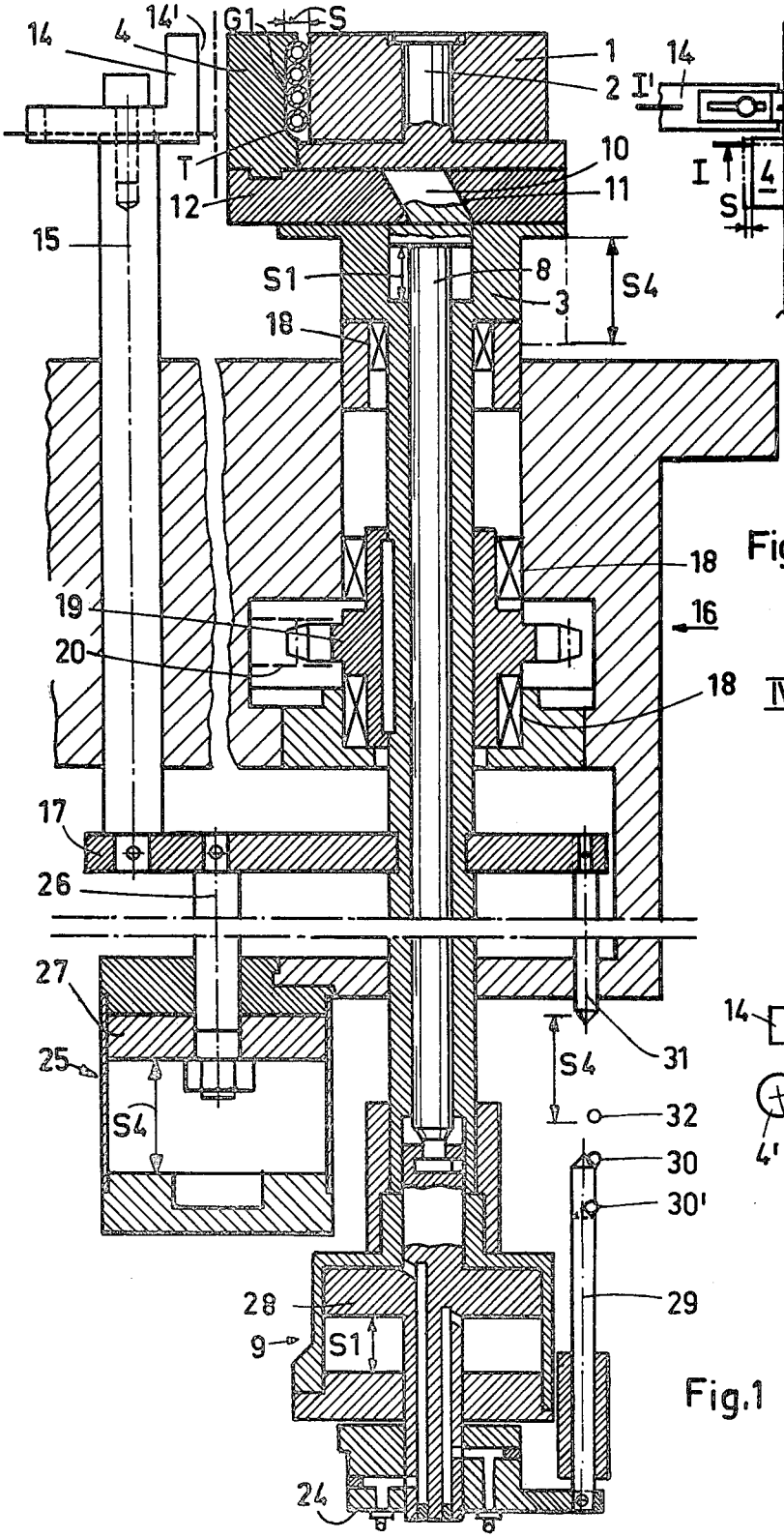
FIG. 1 is a view showing a first longitudinal axial section taken along a plane through I—I of FIG. 2, and a second axial section of the shoulder for the rest of tubes being bent, taken through I'—I' of said FIG. 2, this last mentioned section being taken parallel to the former.

The support and control member 3 cooperates in carrying out the alternating stroke of the sliding block relative to the die. This member 3 has therein a rod 8 which undergoes the axial displacement action S1 by a piston means 9. At the top said rod 8 has a diamond shaped tappet 10 for the transverse alternating displacement or travel S of the sliding block. This tappet 10 can slide within the guide or cam 11 of a supporting slider 12 for the folder sliding block 4, which slider is fixedly guided in said control member 3. FIG. 1 shows that the supporting and control member 3 at its upper end widens to a plate shape. This widening of support 3 rises on two sides, both before and behind the plane of the drawing, to form a U-shaped groove within which the slider 12 is displaceable. On the tops of the two "U" side portions is fixed—by m eans of screws—the base on which the die lies and from which base the pin 2 rises. The base can thus be considered as belonging to the support 3. A shoulder 14, integral with a rod 15 in turn axially movable within the body of unit 16 by means of a bracket 17, acts as a bearing with reference to the die (FIG. 2) for the tubes to be bent.

The control member 3 is rotatably mounted on the unit or assembly body 16 by means of bearings 18 and gear wheel 19. This gear wheel 19 meshes with a chain 20, driven by a series of cylinder-piston assemblies 21 and 22 (FIG. 9). Of these assemblies, the cylinder-piston assembly 21 with larger section and interposition of said chain wheel and chain angularly rotatably drives said control member 3 during the bending step. Its stroke or travel S2 and therewith the angle of rotation for bending are defined by an axially adjustable stop assembly 23 having a threaded stem 23′ and which undergoes a previous action of spring 23″. Said assembly is displaceable through S3 (FIG. 9) as a result of the plunger motion by the control of a microswitch 24 for stopping the bending operation.

The return stroke of the chain 20 is controlled by the second cylinder-piston assembly 22 which is of reduced section relative to the first assembly 21. The arrangement of two cylinders considerably restricts and saves the consumption of pressure air as a result of the favourable ratio between the diameters D1 and D2 of the cylinders.

The axial retraction movement S4 for the control member 3 (FIG. 1), and therewith for said die 1, sliding block 4 and shoulder 14, for allowing the free displacement or movement of the tubes in a sequence of bendings in the bending plane, is carried out by the piston means 25. This piston means is driven by pressure air or other suitable means and provides for retraction movement S4 and upward movement of body 3, respectively, with the interposition of said stem 26, plunger 27 and bracket 17.

The double acting plunger 28, pertaining to said piston means 9, is coaxially and integrally mounted on the control member 3 and hence on the die 1. This plunger 28 controls the central rod 8, and thereby the separation of the folder sliding block 4 from said die 1, or respectively the forward movement of said sliding block towards the die.

Therefore, through the action of inclined planes, the axial stroke of rod 8 generates an alternate transverse movement of the slider 12 as a result of the interengagement between said tappet 10 and cam 11, the latter having a suitable cross-section for providing said displacement action.

The axial stroke Sl of rod 8 is controlled and adjustable by tappet means 29 and microswitches 30, 30′, while the retraction stroke S4 of said die 1, sliding block 4 and shoulder bracket 14 is controlled by the rod 31, which is integral with said bracket 14, and a microswitch 32 thereof.

Referring to FIGS. 5 and 6, a plurality of bending assemblies are preset within a suitable structure 8 for providing a bending sequence in a pair or individually.

FIG. 6 schematically shows the arrangement of six assemblies, of which three bending assemblies U1, U2 and U3 are arranged at one side of the clamping device P and three assemblies U4, U5 and U6 at the opposite side. The tube T, which is straight and of predetermined length, is inserted in the respective shoulders, sliding blocks and dies of the bending assemblies and at the same time within the jaws of the clamping device P, then undergoing a succession of bendings from the two ends of the tube, without the latter being ever displaced or moved.

FIG. 7*a* schematically shows the arrangement for a straight tube ready for bending from its two ends. More particularly, the first bending occurs at 10, at the left as seen in FIG. 7*b*, then bendings 8 and 7, 6 and 5, 4 and 3 are successively made until the tube has the shape shown in FIG. 7*g*.

The rapidity and also the accuracy with which said bendings are carried out will be clearly apparent, and this without any notable stretching of the tube, which is never placed under traction, and also without requiring any displacement for supplying the length of tube required at each individual bending.

With respect to what has been hitherto known, this bending method enables a substantial variation of the die assembly, on which the tube coils somewhat beyond 180°. The die is now configurated with a smooth skirt surface, that is free of any type of groove, or shaping or slot.

In conventional tube bending machines, curves or bends exceeding 180° would make it impossible to withdraw the curved or bent tube in an axial direction from the die, and this as a result of the provision of deep grooves on the cylindrical skirt of the die. Additionally, radial withdrawal is made impossible when bending exceeds 180°.

According to the present invention, the groove hitherto existing on the die is now provided on a folder sliding block which imparts the bend to the tube relative to the axis of the cylindrical die.

This invention enables carrying out a sequence, that is a succession of bendings preferably on tubes having precalculated fixed length, and always leaving free the tube heads and never having to handle the tube. Moreover, the location at which the bending is carried out is now exceeded by a portion Z (FIG. 8) for a successive accomodation of the portion of tube being bent.

The provision of said portion Z considerably contributes to minimizing the tube squeezing or ovalization.

FIG. 8 schematically shows the succession of operations for the sliding block relative to the die.

According to a particular embodiment (FIG. 10), the die is provided with one or more grooves G in order to remove any slight flattening of the tube within the bending. In order not to compromise the removal of the curved tube portion, however the depth thereof is less than the curve or bend enlargement rate, enlargement which is due to the resiliency of the tube material.

The bending process for one or a plurality of tubes at a time comprises the succession of the following steps (FIG. 8):

- introducing the required number of tubes between the respective dies and sliding blocks thereof (FIG. 8*a*);
- clamping said tubes by means of a central clamping device P (FIGS. 6 and 7);
- moving the sliding block toward the die 1 (FIG. 8*b*);
- separating the sliding block from the die, in its stroke taking into account the relaxation of the curved or bent tube (FIGS. 8*d*, 8*f*); and
- returning the sliding block to its starting position and simultaneously retracting the die and sliding block for the displacement of the curved or bent tube portions and successive bending operations (FIGS. 8*e*, 8*g*).

Referring to the last mentioned figures of the drawings, the sliding block portion which, according to the rotational movement for bending is the rear portion, is displaced by Z (FIGS. 8*a*, 8*b*) relative to a plane through the die axis and which is perpendicular to the groove surface of said sliding block.

As outlined in the foregoing, in order to sequentially provide the bending and exploit the advantages achievable by simultaneously loading a plurality of tubes at a time within a plurality of bending assemblies, the individual tube to be bent should have a precalculated fixed length. Therefore, when lengths are not constant and have some tolerance, for example when the interspacings X2 (FIG. 21) of determined bending centers and when the ends of the curved or bent tube have to be aligned, that is with the minimal tolerances X1 (FIG. 20), it is always necessary to resort to a preliminary centering of the tube being bent.

In addition to the above described bending assembly, the invention further contemplates a tube centering assembly for centering such a tube prior to carrying out bendings thereon.

However, it is always convenient to center the tube or pieces when, for example, such elements undergo an intermediate processing, such as reduction in diameter, shaping or the like, which modifies the original length by a variable elongation thereof.

Centering is particularly advantageous, for example, in the art of armoured strength tube bending to avoid the preliminary heading operation thereon. Centering can be simultaneously carried out on a plurality of tubes.

According to an exemplary embodiment, the assembly enables the centering of one or two tubes at a time. Moreover, the apparatus which in addition to said assembly comprises a plurality of bending assemblies available on slides, allows taking up the tolerance between different bendings to provide equal external sizes on a curved or bent tube.

The apparatus is line mounted in a metal structure. When inserted, it automatically provides for the tube (or tubes) displacement and positions the tube in accordance with the center line thereof (FIG. 19) and then bending takes place, providing the piece with the two ends aligned (FIG. 20).

The apparatus also enables varying one or more centers of bending (FIGS. 21 and 22) to have the ends always aligned and also constant outer sizes L1.

In order to achieve the take up X2 between bendings, the bending assembly or assemblies corresponding to the tolerance take up are positioned and the other bending assemblies are displaced by an amount which is equal to the tolerance differential.

The bending assemblies are mounted on slides which are controlled by the centering assembly. When the slides are positioned, the slides are friction clamped to the lower guide of the structure supporting the whole apparatus.

Then, the bending operation commences.

Referring to FIGS. 11 and 12, 13 and 14, 18*a* and 18*b*, the apparatus to which the centering assembly pertains, comprises a first head 40 and a second head 41, in turn preset on a lower guide 42 and an upper guide 43, respectively, of a structure B.

In the same plane said first head 40 encloses lower and upper gear wheels 44 and 45, respectively, having the same pitch diameter. Such wheels are rotated by corresponding cylinders 46 and 47 actuated, for example, by pressure air and which are prearranged in a structure ST mounted against one face of the first head 40 (FIG. 11). The stems for said cylinders extend to form a toothed rod 48, 49 meshing with the respective said gear wheel 44 and 45.

Diametrically to said toothed rods, further toothed rods 50 and 51 are arranged and linearly slidably guided. These further toothed rods mesh with said gear wheels 44 and 45 and by the interposition of bars 52 and 53 transmit to the second head 41 the linear motion received from the first head 40.

Centrally and at least in a plane parallel to said gear wheels 44 and 45, one or more hollow shafts 65 are slidably guided within the first head 40, such shaft or shafts 65 being provided with a movable feeler 71, further described in the following, which shaft or shafts being also operated by said cylinders 46 and 47.

In order to displace a first slide S1′ provided with a bending assembly, a lever 66 is mounted on the extension of the toothed rod 49 of the first head 40, which lever slides along a stem 67 which is made integral with the first slide by means of a clamp or yoke 68".

Similarly, for the displacement of the second slide S2', the toothed rod 59 of the second head 41 is provided with a lever 69 sliding along the stem 70, which is made integral with the slide S2' by means of a clamp or yoke 68".

Similarly to the first head 40, the second head 41 has in the lower and upper portions a toothed or gear wheel 56 and 57 rotated by toothed bushings 58 and 59. The latter are arranged coaxial with said bars 52 and 53, which are also provided with spacing bushings 54' and 55' and stops 54 and 55.

The second head 41 further comprises the idle gear wheels 60 and 61 engaging the toothed shafts 62 and 62', respectively, in which an axial cavity 63 is formed for receiving a preventive tensioning spring 64. Said shafts are also provided with a feeler for the tube to be centered, as further described in the following.

Said stems 67 and 70 have mounted thereon a clamp 68, 68' integral with the slides S1', S2', the clamp being spaced apart by M or respectively M' from the respective said levers 66, 69.

By moving along with the hollow shaft 65 and after an approach stroke or travel M, the lever 66 of the first head will press against the clamp 68 with resulting displacement of slide S1', and this until the sliding feeler 71 is struck by the corresponding tube head.

Similarly, after a displacement M1 the lever 69 (FIG. 13) will displace the slide S2' with simultaneous advancement of the toothed shaft 62 provided with the fixed feeler 71'.

The sliding feeler 71 (FIG. 11) is subjected to the preventive action of a spring 72. After the impact with the tube, the feeler 71 will press against a microswitch 73 for shutting off the travel or stroke of the plunger for cylinder 47 and provide for closing a tube clamping device.

At the same time, the microswitch 73 controls the clamping of slides S1', S2' by means of an assembly S3' comprising a cylinder-piston and lever (FIG. 16).

After positioning thereof, said slides S1' and S2' are clamped by friction (FIG. 16) against the lower guide 42 or upper guide 43, or both of structure B. Clamping occurs as a result of forced bearing of a shoulder 74 of a cut out transversely formed in a pin 75, which is guided in its alternating motion within a support 76, which is also a support for a cylinder-piston unit, such as a cylinder-piston unit 77. By means of a lever 78, for example a first class lever, said cylinder 77 imparts the linear displacement to said pin 75 with resulting clamping or release, respectively, of said slides.

The return of slides S1' and S2' to the initial position takes place under the action of pneumohydraulic cylinder assemblies 79, 79' mounted on said heads 40 and 41. Therein, the oil performs the function of ensuring a constant inlet and return speed for the slides.

The displacement of said slides S1' and S2' with respect to the central shafts 65 and 62 may be differentiated. This occurs by means of toothed rods 80 and 81 (FIGS. 12 and 14) meshing with gear wheels 45' and 57', the pitch diameter of which is reduced relative to the above mentioned gear wheels 45 and 57.

A yoke 83 integral with the stem 67 is mounted on the end of stem 82 of the pneumohydraulic cylinder assembly 79 (FIG. 17) for the return of slides S1, S2 to the initial position thereof upon completion of the bending cycle.

The positioners O1, O2 (FIGS. 18 and 23) for the piece to be centered and respectively bent have a notch 84 with parallel sides 84', 84". As shown in FIG. 23, one or two superimposed tubes are insertable in said notch or cavity 84, each of which tubes is retained by a point or center 85 under the preventive action of a spring 86.

Referring to the example schematically shown in FIGS. 18*a* and 18*b*, the centering, bending and tolerance take up operations are as follows:

- the bending assemblies P5 and P7 are secured on the guides 42 and 43 of structure B;
- the bending assemblies P1, P2, P3, P4 and P6, as well as the tube clamping device DB, are mounted on the slide S2', and bending assemblies P10, P11, P14, P15 and P16 are secured on the slide S1';
- for the guidance of piece T, retractable positioners O1 and O2 are provided at the ends thereof in order not to obstruct the piece bending.

The bending, for example of only one piece, is carried out as follows:

(a) introduction of the piece (one or two) into the positioners O1 and O2, displacement by means of the cylinder 47 of shaft 65 and toothed rods 49 and 51, and by means of the gear wheel 45 and with the interposition of bar 53 the displacement of the toothed rod 59 and hence of shaft 62 by means of the gear wheels 57 and 61;

(b) the shafts 65 and 62 continue in their linear displacement until the feelers 71, 71' come in contact with the respective heads of piece T;

(c) the lever 66, which is fixedly mounted on the toothed rod 49, moving along with shaft 65 (as simultaneously occurs to the right as seen in this same figure) and after completing an approach stroke M, starts to displace said slides S1' and S2', until the feeler 71 comes in contact with the piece T. The piece is conveniently positioned somewhat rightwardly displaced so that the feeler 71', which is fixed, bears on the tube before said feeler 71, then continuing to move along with the piece;

(d) when the feeler 71 is struck by the piece being centered, a microswitch 73 stops the advancement of the plunger of cylinder 47 and at the same time controls the closing of the piece clamping assembly DB (FIG. 18*b*), as well as the securing of said slides S1' and S2' by means of the cylinder-lever assembly S3;

(e) return of the plunger of cylinder 47 along with the toothed rod 62 and hollow shaft 65;

(f) retraction of the positioners O1 and O1 mounted on the supports O' and O", so that the tube can be bent;

(g) complete bending of the tube;

(h) opening of the tube clamping device DB and unloading of the bent tube; and (i) return of slides S1' and S2' to the initial position by means of pneumohydraulic cylinder-piston assemblies 79 and 79'.

By omitting the piston means 9 for rod 8, tappet 10 and slider 12, which impart a radial displacement S to the sliding block 4 and also replacing said sliding block 4 with a roller 4', the assembly can be used for the bending of wire, strip and general sections, either of metal or other material (FIG. 24).

Although the invention has been described and shown with reference to preferred exemplary embodiments thereof, which have proved to be satisfactory, those skilled in the art will readily understand that many changes and modifications can be made thereto without departing from the scope of the invention.

What is claimed is:

1. A tube bending assembly, particularly for metal tubes of small and medium diameter and thin wall, comprising a rotatable die with a substantially smooth cylindrical skirt; a sliding block angularly rotatable relative to the axis of rotation of said die, this sliding block being provided with a groove so shaped as to receive or accomodate one or more tubes to be bent; said sliding block groove and a tube bearing plane being arranged parallel to the longitudinal axis of the tube to be bent; said die and sliding block and shoulder being retractable in a direction perpendicular to the bending plane and upon bending.

2. A bending assembly according to claim 1, wherein the groove in the sliding block is elongated and rectilinear and with respect to a location tangent to the die, extends in an opposite direction to that of rotation of the sliding block as the tube is bent.

3. A bending assembly according to claim 1, wherein one or more grooves are formed in the cylindrical wall of the die, the depth of such grooves being nearly the same as the enlargement rate as a result of the resiliency of the bent tube portion, for simultaneous retraction of said die, sliding block and shoulder at completion of the bending operation.

4. A bending assembly according to claim 1, wherein in a sliding block the groove receiving a plurality of tubes has such a shaping as to accomodate the tubes in adjacent relationship to one another.

5. A bending assembly according to claim 1, wherein the radial stroke of the sliding block to or respectively from the die is provided by interengagement of a tappet and cam, the latter comprising inclined planes cooperating with each other, so that a radial displacement of the cam and hence of the sliding block will correspond to the axial displacement of the tappet.

6. A bending assembly according to claim 1, wherein a slider is a support for the folder sliding block, which slider is guided in the control member.

7. A bending assembly according to claim 1, wherein the control member is rotatably driven by means of two pistons with the interposition of a chain and gear wheel, of which a first bending engagement piston is made with larger section that the second return piston for the control member in order to minimize the consumption of pressure fluid or energy of any kind.

8. A process for practicing the assembly according to claim 1, comprising the following steps of:

introducing the required number of tubes into between the respective dies and sliding blocks thereof;

clamping these tubes by means of a central clamping device;

approaching the sliding block to the die;

angularly rotating the sliding block about the die axis;

separating the sliding block from the die; and returning the sliding block to its starting position and simultaneously retracting said die and sliding block for successive bending operations.

9. An apparatus for carrying into effect the process according to claim 8, which apparatus comprises tube centering, clamping and bending means and take up means for the tolerance on the legs or between different bendings, wherein said means are in line arranged in a structure and the centering means comprise two heads for positioning on the structure guides, said heads are provided with centering elements for moving to or respectively retract relative to the two opposite faces or sides of the heads, the axial displacements of the centering elements being controlled by pneumatic means, with the interposition of toothed linear displacement members, bars and wheelworks.

10. An apparatus according to claim 9, wherein at said heads the supporting guides are interposed for the tube, in turn displaceable therein in longitudinal direction, said guides being retractable relative to the support thereof, or respectively relative to the tube bending plane.

11. An apparatus according to claim 9, wherein the tube clamping and bending means are interposed at said heads and said guides.

12. An apparatus according to claim 9, wherein the tube clamping and bending means are preferably mounted in one or more slides, which can be clamped by means of a cylinder-piston assembly and lever.

13. An apparatus according to claim 9, wherein said slides are mounted for movement toward each other along parallel guides under the action of a cylinder-piston assembly integral with the first head, of which a stem extension is provided with a lever acting upon the slide with the interposition of a clamp and stem, the second slide being displaceable from the second head by means of a toothed element also provided with a lever which by the interposition of a clamp and stem acts upon the respective slide.

14. An apparatus according to claim 9, wherein the return of the slides to the initial position is provided by pneumohydraulic cylinder-piston assemblies or other well known systems.

15. A bending assembly according to claim 1, wherein omitting the piston means, rod, tappet, and sliders, which impart a radial displacement to the sliding block, and further replacing the sliding block with a roller, the assembly can be used for the bending of wire, strip and general sections, either of metal or other material.

* * * * *